US010825438B2

(12) United States Patent
Iwase

(10) Patent No.: US 10,825,438 B2
(45) Date of Patent: Nov. 3, 2020

(54) ELECTRONIC MUSICAL INSTRUMENT, MUSICAL SOUND GENERATING METHOD OF ELECTRONIC MUSICAL INSTRUMENT, AND STORAGE MEDIUM

(71) Applicant: CASIO COMPUTER CO., LTD., Tokyo (JP)

(72) Inventor: Hiroshi Iwase, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 110 days.

(21) Appl. No.: 16/130,278

(22) Filed: Sep. 13, 2018

(65) Prior Publication Data

US 2019/0096379 A1 Mar. 28, 2019

(30) Foreign Application Priority Data

Sep. 27, 2017 (JP) ..... 2017-186690

(51) Int. Cl.
*G10H 7/04* (2006.01)
*G10L 19/16* (2013.01)
(Continued)

(52) U.S. Cl.
CPC ..... *G10H 7/04* (2013.01); *G10H 1/06* (2013.01); *G10H 1/125* (2013.01);
(Continued)

(58) Field of Classification Search
CPC ..... G10L 19/0019; G10L 19/02; G10H 2250/481
See application file for complete search history.

(56) References Cited

U.S. PATENT DOCUMENTS 8,735,709 B2 * 5/2014 Yamauchi ..... G10H 1/10 84/609
2001/0037196 A1 * 11/2001 Iwamoto ..... G10H 1/366 704/207
(Continued)

FOREIGN PATENT DOCUMENTS

JP H09-204185 A 8/1997
JP H10-240264 A 9/1998
(Continued)

OTHER PUBLICATIONS

Japanese Office Action dated May 22, 2018, in a counterpart Japanese patent application 2017-186690. (A machine translation (not reviewed for accuracy) attached.).
(Continued)

*Primary Examiner* — Brian L Albertalli
(74) *Attorney, Agent, or Firm* — Chen Yoshimura LLP

(57) ABSTRACT

An electronic musical instrument includes: a memory that stores, before performance of a musical piece on the electronic musical instrument by a performer begins, pitch variation data that represents differences between fundamental tone frequencies of notes in a melody of the musical piece and fundamental tone frequencies of notes in prescribed singing voice waveform data; and a sound source that outputs a pitch-adjusted carrier signal to be received by a waveform synthesizing device that generates synthesized waveform data based on the pitch-adjusted carrier signal, the pitch-adjusted carrier signal being generated on the basis of the pitch variation data acquired from the memory and performance instruction pitch data that represent pitches specified by the performer during the performance of the musical piece on the electronic musical instrument, the pitch-adjusted carrier signal being generated even when the
(Continued)

performer does not sing after performance of the musical piece begins.

11 Claims, 10 Drawing Sheets

(51) Int. Cl.

| | |
|---|---|
| ***G10L 19/00*** | (2013.01) |
| ***G10H 1/06*** | (2006.01) |
| ***G10H 1/12*** | (2006.01) |
| *G10L 21/013* | (2013.01) |

(52) U.S. Cl.
CPC ..... *G10L 19/0019* (2013.01); *G10L 19/16* (2013.01); *G10H 2250/295* (2013.01); *G10H 2250/455* (2013.01); *G10L 21/013* (2013.01)

(56) References Cited

U.S. PATENT DOCUMENTS

2003/0221542 A1* 12/2003 Kenmochi ..... G10H 7/002 84/616
2011/0000360 A1* 1/2011 Saino ..... G10H 1/0008 84/622
2011/0144982 A1* 6/2011 Salazar ..... G10H 1/366 704/207
2015/0040743 A1 2/2015 Tachibana
2015/0310850 A1* 10/2015 Nakano ..... G10L 13/10 704/258
2017/0025115 A1* 1/2017 Tachibana ..... G10L 13/0335

FOREIGN PATENT DOCUMENTS

| | | | |
|---|---|---|---|
| JP | 2001-249668 | A | 9/2001 |
| JP | 2006-154526 | A | 6/2006 |
| JP | 2009-122611 | A | 6/2009 |
| JP | 2015-34920 | A | 2/2015 |
| JP | 2015-179143 | A | 10/2015 |

OTHER PUBLICATIONS

Japanese Office Action dated Dec. 18, 2018, in a counterpart Japanese patent application 2017-186690. (A machine translation (not reviewed for accuracy) attached.).

* cited by examiner

ELECTRONIC MUSICAL INSTRUMENT, MUSICAL SOUND GENERATING METHOD OF ELECTRONIC MUSICAL INSTRUMENT, AND STORAGE MEDIUM

BACKGROUND OF THE INVENTION

Technical Field

The present invention relates to an electronic musical instrument, a musical sound generating method of an electronic musical instrument, and a storage medium.

Background

Heretofore, technologies of musical piece playing devices that enable a singing voice sound to be played using keyboard operation elements or the like have been proposed (for example, technology disclosed in Patent Document 1). In this related art, a so-called vocoder technology is proposed in which the voice sound level of each frequency band in an input voice sound (modulator signal) is measured using a plurality of band pass filter groups (analysis filter group, vocal tract analysis filters) having different center frequencies from each other, electronic sounds (carrier signals) played using keyboard operation elements are passed through a plurality of band pass filter groups (reproduction filter group, vocal tract reproduction filters) having different center frequencies from each other, and the output level of each band pass filter is controlled on the basis of the measured voice sound levels. With this vocoder technology, the sounds played using the keyboard operation elements are changed to sounds that resemble those made when a person talks.

In addition, heretofore, as a voice sound generation method for generating a person's voice, a technology has also been known in which a person's voice is imitated by inputting a continuous waveform signal that determines the pitch through a filter (vocal tract filter) that models the vocal tract of a person.

Furthermore, a sound source technology of an electronic musical instrument is also known in which a physical sound source is used as a device that enables wind instrument sounds or string instrument sounds to be played using keyboard operation elements or the like. This related art is a technology called a waveguide and enables musical instrument sounds to be generated by imitating the changes in the vibration of a string or air using a digital filter.

Patent Document 1: Japanese Patent Application Laid-Open Publication No. 2015-179143

However, in the above-described related art, although the waveform of a sound source can approximate a person's voice or a natural musical instrument, the pitch (pitch change) of the output sound is determined in a uniform manner using an electronic sound (carrier signal or excited signal) having a constant pitch based on the pitch played using a keyboard operation element, and therefore a pitch change is monotone and does not reflect reality. Accordingly, the present invention is directed to a scheme that substantially obviates one or more of the problems due to limitations and disadvantages of the related art.

Accordingly, an object of the present invention is to reproduce not only formant changes, which are characteristics of an input voice sound, but to also reproduce pitch changes of the input voice sound.

SUMMARY OF THE INVENTION

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an electronic musical instrument including: a memory that stores, before performance of a musical piece on the electronic musical instrument by a performer begins, pitch variation data that represents differences between fundamental tone frequencies of notes in a melody of the musical piece and fundamental tone frequencies of notes in prescribed singing voice waveform data, the prescribed singing voice waveform data representing or simulating a singing voice that is generated when a person actually sings the melody of the musical piece; and a sound source that outputs a pitch-adjusted carrier signal to be received by a waveform synthesizing device that generates synthesized waveform data based on the pitch-adjusted carrier signal, the pitch-adjusted carrier signal being generated on the basis of the pitch variation data acquired from the memory and performance instruction pitch data that represent pitches specified by the performer during the performance of the musical piece on the electronic musical instrument, the pitch-adjusted carrier signal being generated even when the performer does not sing after performance of the musical piece begins.

In another aspect, the present disclosure provides a method performed by an electronic musical instrument that includes: a memory that stores, before performance of a musical piece on the electronic musical instrument by a performer begins, pitch variation data that represents differences between fundamental tone frequencies of notes in a melody of the musical piece and fundamental tone frequencies of notes in prescribed singing voice waveform data, the prescribed singing voice waveform data representing or simulating a singing voice that is generated when a person actually sings the melody of the musical piece, and a plurality of pieces of amplitude data that represent characteristics of the singing voice generated on the basis of the prescribed singing voice waveform data and that respectively correspond to a plurality of frequency bands; a sound source; and a waveform synthesizing device, the method including: causing the sound source to output a pitch-adjusted carrier signal generated on the basis of the pitch variation data acquired from the memory and performance instruction pitch data that represent pitches specified by the performer during the performance of the musical piece on the electronic musical instrument, the pitch-adjusted carrier signal being generated even when the performer does not sing after performance of the musical piece begins; and causing the waveform synthesizing device to modifies the pitch-adjusted carrier signal in accordance with the plurality of pieces of amplitude data acquired from the memory so as to generate and output synthesized waveform data.

In another aspect, the present disclosure provides a non-transitory computer-readable storage medium having stored thereon a program executable by an electronic musical instrument that includes: a memory that stores, before performance of a musical piece on the electronic musical instrument by a performer begins, pitch variation data that represents differences between fundamental tone frequencies of notes in a melody of the musical piece and fundamental tone frequencies of notes in prescribed singing voice waveform data, the prescribed singing voice waveform data representing or simulating a singing voice that is generated when a person actually sings the melody of the musical piece, and a plurality of pieces of amplitude data that represent characteristics of the singing voice generated on the basis of the prescribed singing voice waveform data and that respectively correspond to a plurality of frequency bands; a sound source; and a waveform synthesizing device, the program causing the electronic musical instrument to perform the following: causing the sound source to output a pitch-adjusted carrier signal generated on the basis of the pitch variation data acquired from the memory and performance instruction pitch data that represent pitches specified by the performer during the performance of the musical piece on the electronic musical instrument, the pitch-adjusted carrier signal being generated even when the performer does not sing after performance of the musical piece begins; and causing the waveform synthesizing device to modifies the pitch-adjusted carrier signal in accordance with the plurality of pieces of amplitude data acquired from the memory so as to generate and output synthesized waveform data.

It is to be understood that both the foregoing general description and the following detailed description are exemplary and explanatory, and are intended to provide further explanation of the invention as claimed.

BRIEF DESCRIPTION OF THE DRAWINGS

The present invention will be more understood with reference to the following detailed descriptions with the accompanying drawings.

DETAILED DESCRIPTION OF EMBODIMENTS

Figure 1:
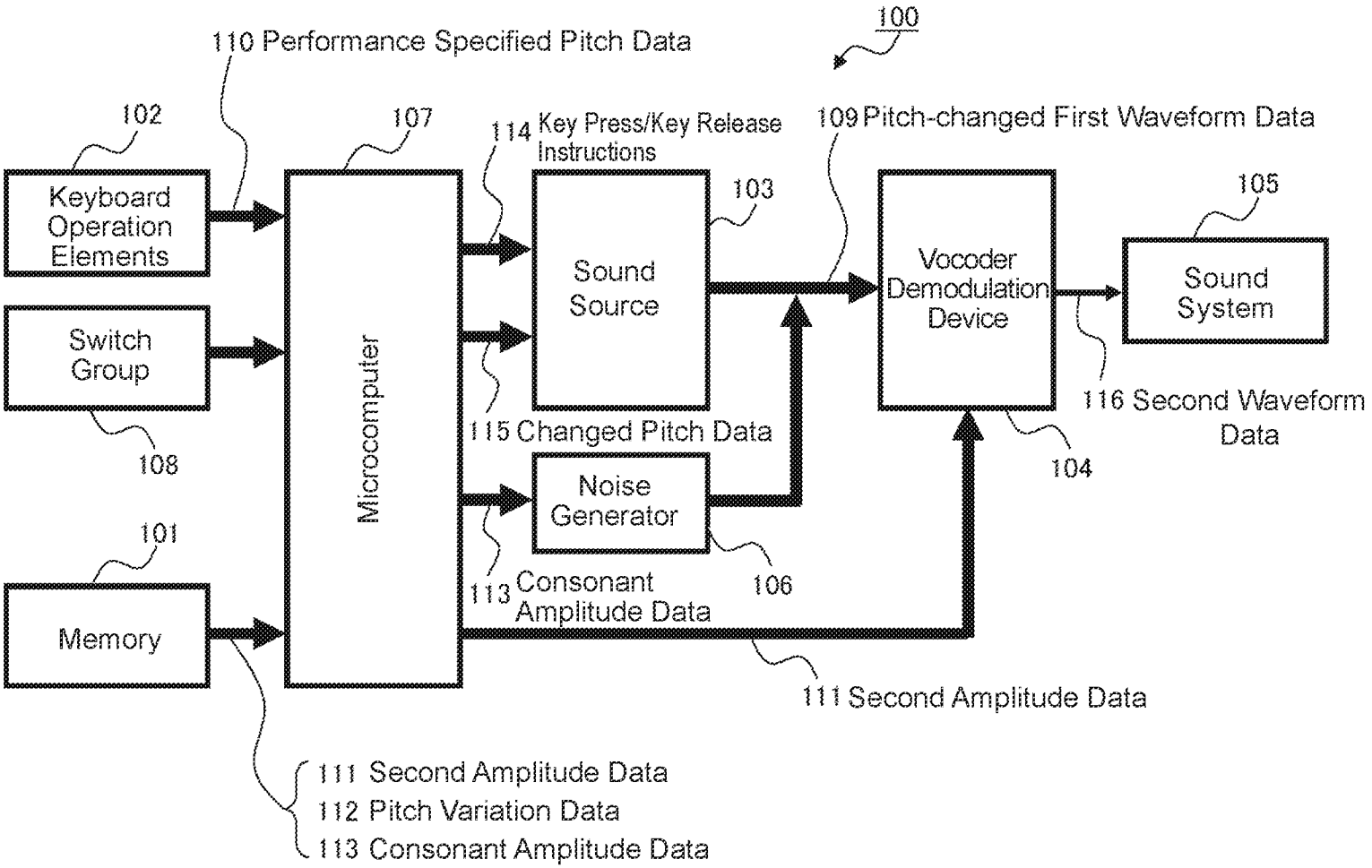
FIG. 1 is a block diagram of an embodiment of an electronic musical instrument.

Hereafter, embodiments for carrying out the present invention will be described in detail while referring to the drawings. FIG. 1 is a block diagram of an embodiment of an electronic musical instrument 100. The electronic musical instrument 100 includes a memory 101, keyboard operation elements 102, a sound source 103, a vocoder demodulation device (waveform synthesizing device) 104, a sound system 105, a microcomputer 107 (processor), and a switch group 108.

The memory 101 stores: second amplitude data 111, which is time series data of amplitudes, which respectively correspond to a plurality of frequency bands of tones (notes) included in singing voice waveform data (voice sound data) of an actually sung musical piece; pitch variation data 112, which is time series data representing differences between the fundamental tone frequencies of vowel segments of tones (notes) included in a melody (e.g., model data) of singing of a musical piece (the term "fundamental tone frequency" used in the present specification means the frequency of a fundamental tone or the fundamental frequency of a fundamental tone) and fundamental tone frequencies of vowel segments of tones included in the singing voice waveform data; and consonant amplitude data 113, which is time series data corresponding to consonant segments of the tones of the singing voice waveform data. The second amplitude data 111 is time series data used to control the gains of band pass filters of a band pass filter group of the vocoder demodulation device 104 that allows a plurality of frequency band components to pass therethrough. The pitch variation data 112 is data obtained by extracting, in time series, difference data between fundamental tone frequency data of pitches (e.g., model pitches) that are set in advance for vowel segments of tones included in a melody, and fundamental tone frequency data of vowel segments of tones included in singing voice waveform data obtained from actual singing. The consonant amplitude data 113 is a time series of noise amplitude data of consonant segments of tones included in the singing voice waveform data.

The keyboard operation elements 102 input, in time series, performance specified pitch data (performance instruction pitch data) 110 that represents pitches specified by a user via performance operations performed by the user.

As pitch change processing, the microcomputer 107 generates a time series of changed (adjusted) pitch data 115 by changing the time series of the performance specified pitch data 110 input from the keyboard operation elements 102 on the basis of a time series of the pitch variation data 112 sequentially input from the memory 101.

Next, as first output processing, the microcomputer 107 outputs the changed pitch data 115 to the sound source 103, and generates a time series of key press/key release instructions 114 corresponding to key press and key release operations of the keyboard operation elements 102 and outputs the generated time series of key press/key release instructions 114 to the sound source 103.

On the other hand, as noise generation instruction processing, in consonant segments of the tones included in the singing voice waveform data corresponding to operations of the keyboard operation elements 102, for example, in prescribed short time segments preceding the sound generation timings of the tones, the microcomputer 107 outputs, to a noise generator 106, the consonant amplitude data 113 sequentially read from the memory 101 at the timings of the consonant segments instead of outputting the pitch variation data 112 to the sound source 103.

In addition, as a part of amplitude changing processing, the microcomputer 107 reads out, from the memory 101, a time series of a plurality of pieces of the second amplitude data 111 respectively corresponding to a plurality of frequency bands of tones included in the singing voice waveform data and outputs the times series to the vocoder demodulation device 104.

The sound source 103 outputs, as pitch-changed (pitch-adjusted) first waveform data 109, waveform data having pitches corresponding to fundamental tone frequencies corresponding to the changed pitch data 115 input from the microcomputer 107 while controlling starting of sound generation and stopping of sound generation on the basis of the key press/key release instructions 114 input from the microcomputer 107 through control realized by the first output processing performed by the microcomputer 107. In this case, the sound source 103 operates as an oscillator that oscillates the pitch-changed first waveform data 109 as a carrier signal for exciting the vocoder demodulation device 104 connected in the subsequent stage. Therefore, the pitch-changed first waveform data 109 includes a triangular-wave harmonic frequency component often used as a carrier signal or a harmonic frequency component of an arbitrary musical instrument in vowel segments of the tones included in the singing voice waveform data, and is a continuous waveform that repeats at a pitch corresponding to the changed pitch data 115.

In addition, in a consonant segment that exists at the start time and so on of the sound generation timing of each tone of the singing voice waveform data, before the sound source 103 performs outputting, the noise generator 106 (or consonant waveform generator) generates consonant noise (for example, white noise) having an amplitude corresponding to the consonant amplitude data 113 input from the microcomputer 107 through control realized by the above-described noise generation instruction processing performed by the microcomputer 107 and superimposes the consonant noise on the pitch-changed first waveform data 109 as consonant segment waveform data.

Through control of the above-described amplitude changing processing performed by the microcomputer 107, the vocoder demodulation device (can also be referred to as an output device, a voice synthesizing device, or a waveform synthesizing device, instead of a vocoder demodulation device) 104 changes a plurality of pieces of first amplitude data, which are obtained from the pitch-changed first waveform data 109 output from the sound source 103 and respectively correspond to a plurality of frequency bands, on the basis of the plurality of pieces of second amplitude data 111 output from the microcomputer 107 and respectively corresponding to a plurality of frequency bands of tones included in the singing voice waveform data. In this case, the vocoder demodulation device 104 is excited by consonant noise data included in the pitch-changed first waveform data 109 in a consonant segment of each tone of the singing voice waveform data described above, and is excited by the pitch-changed first waveform data 109 having a pitch corresponding to the changed pitch data 115 in the subsequent vowel segment of each tone.

Next, as second output processing specified by the microcomputer 107, the vocoder demodulation device 104 outputs second waveform data (synthesized waveform data) 116, which is obtained by changing each of the plurality of pieces of first amplitude data, to the sound system 105, and the data is then output from the sound system 105 as sound.

The switch group 108 functions as an input unit that inputs various instructions to the microcomputer 107 when a user takes a lesson regarding (learns) a musical piece.

The microcomputer 107 executes overall control of the electronic musical instrument 100. Although not specifically illustrated, the microcomputer 107 is a microcomputer that includes a central arithmetic processing device (CPU), a read-only memory (ROM), a random access memory (RAM), an interface circuit that performs input and output to and from the units 101, 102, 103, 104, 106, and 108 in FIG. 1, a bus that connects these devices and units to each other, and the like. In the microcomputer 107, the CPU realizes the above-described control processing for performing musical piece by executing a musical piece performance processing programs stored in the ROM using the RAM as a work memory.

The above-described electronic musical instrument 100 is able to produce sound by outputting the second waveform data 116 which is obtained by adding the nuances of a person's singing voice to the pitch-changed first waveform data 109 of a melody, musical instrument sound etc. that reflects the nuances of pitch variations of a singing voice generated by the sound source 103.

Figure 2:
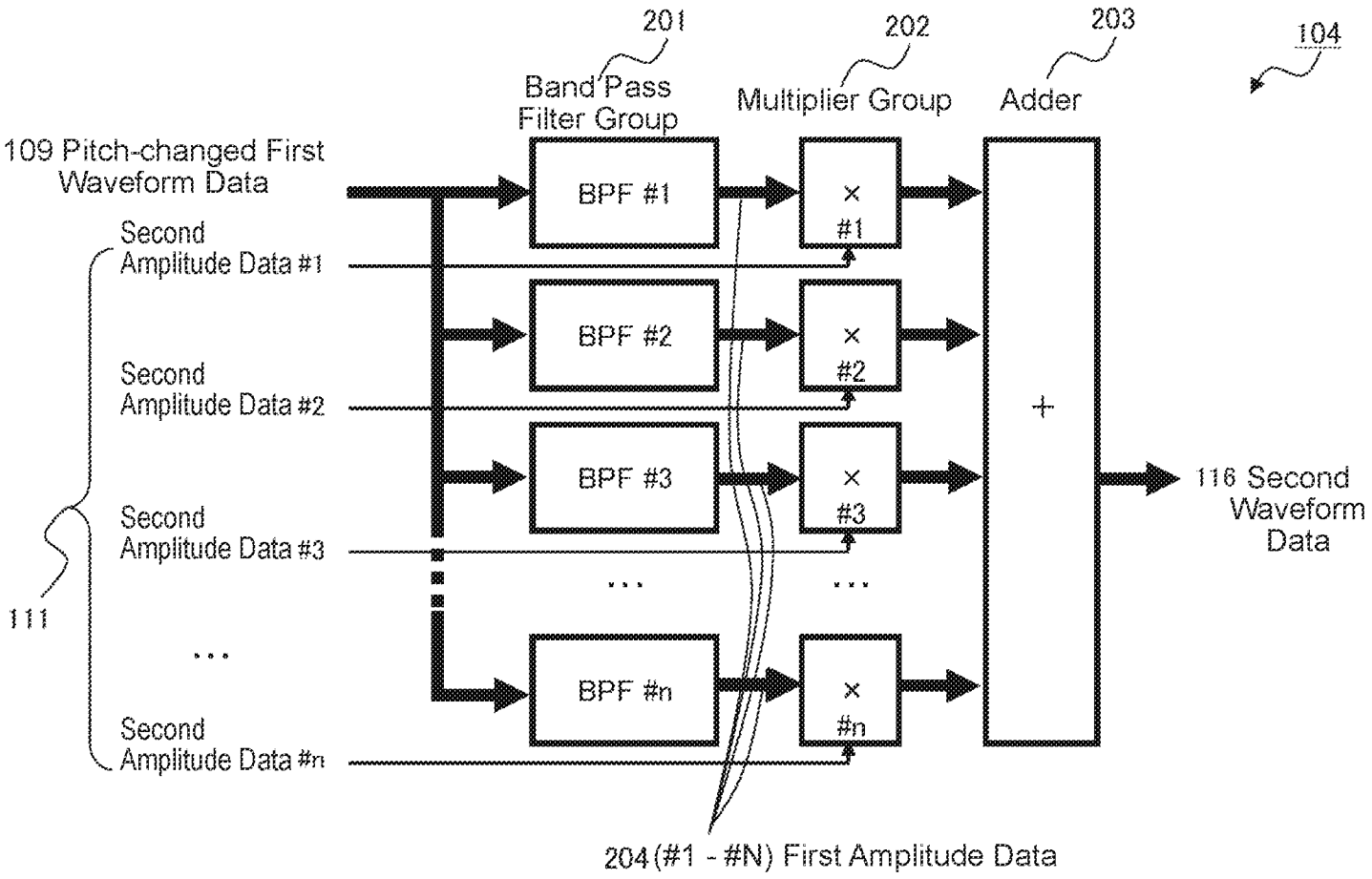
FIG. 2 is a block diagram illustrating the detailed configuration of a vocoder demodulation device.

FIG. 2 is a block diagram illustrating the detailed configuration of the vocoder demodulation device (waveform synthesizing device) 104 in FIG. 1. The vocoder demodulation device 104 receives, as a carrier signal, the pitch-changed first waveform data (pitch-adjusted carrier signal) 109 output from the sound source 103 or the noise generator 106 in FIG. 1 and includes a band pass filter group 201 that is composed of a plurality of band pass filters (BPF #1, BPF #2, BPF #3, . . . , BPF # n) that respectively allow a plurality of frequency bands to pass therethrough.

In addition, the vocoder demodulation device 104 includes a multiplier group 202 that is composed of a plurality of multipliers (x #1 to x # n) that respectively multiply the first amplitude data 204 (#1 to # n) output from the band pass filters (BPF #1, BPF #2, BPF #3, . . . , BPF # n) by the values of the #1 to # n pieces of second amplitude data 111 input from the microcomputer 107.

Furthermore, the vocoder demodulation device 104 includes an adder 203 that adds together the outputs from the multipliers (x #1 to x # n) of the multiplier group 202 and outputs the second waveform data 116 in FIG. 1.

The above-described vocoder demodulation device 104 in FIG. 2 enables to add a voice spectrum envelope characteristic (formant characteristic) corresponding to the singing voice of a musical piece to the input pitch-changed first waveform data 109 by the band pass filter group 201 that has the filtering characteristics thereof controlled on the basis of the second amplitude data 111.

Figure 3:
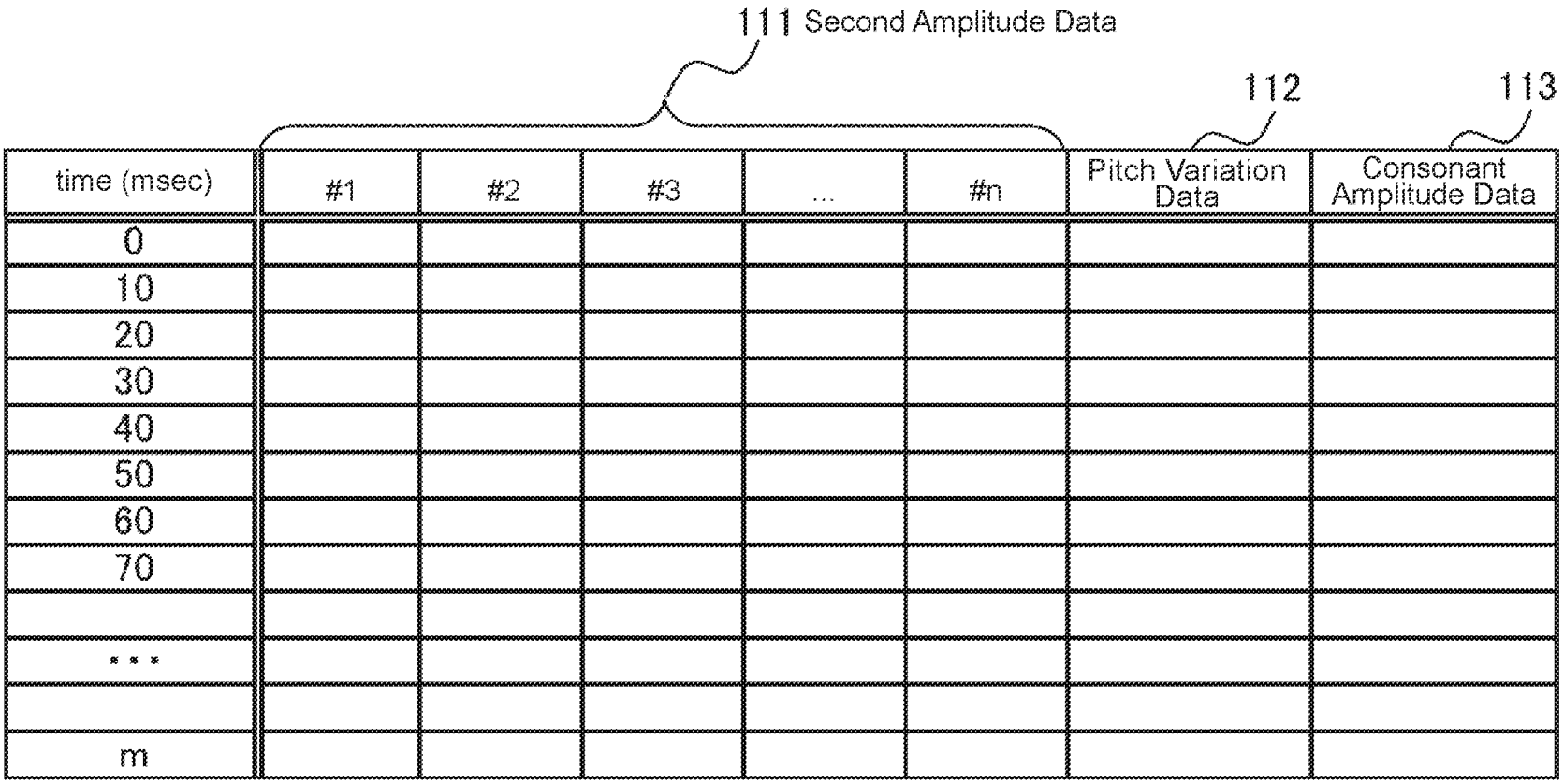
FIG. 3 is a diagram illustrating a data configuration example of a memory.

FIG. 3 is a diagram illustrating a data configuration example of the memory 101 in FIG. 1. The #1, #2, #3, . . . , # n pieces of second amplitude data 111 (FIG. 1) output from the vocoder modulation device 401 in FIG. 4 described later are stored for each unit of time (time) obtained by dividing the passage of time of a lyric voice of a musical piece every 10 msec, for example. The memory 101 also stores, for every elapsed unit of time, the pitch variation data 112 which is constituted by shifts in the pitches of the tones of the singing voice waveform data that occur when the melody is actually sung with respect to for example model pitches in vowel segments of the tones of the melody in a musical score. In addition, the consonant amplitude data 113 corresponding to consonant segments of the tones of the singing voice waveform data is stored.

Figure 4:
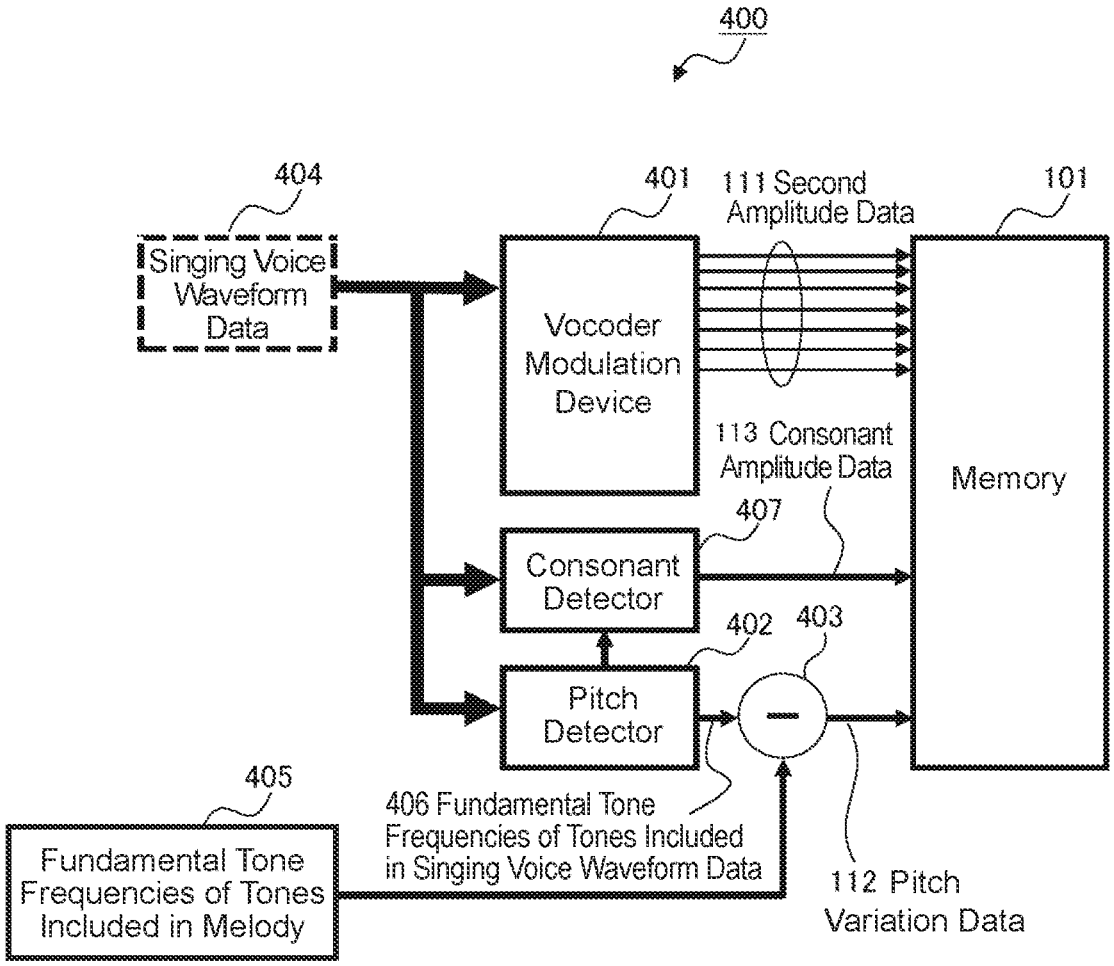
FIG. 4 is a block diagram of a voice sound modulation device 400.

FIG. 4 is a block diagram of a voice sound modulation device 400 that generates the second amplitude data group 111, the pitch variation data 112, and the consonant amplitude data 113. The voice sound modulation device 400 includes the vocoder modulation device 401, a pitch detector 402, a subtractor 403, and a consonant detector 407.

The vocoder modulation device 401 receives singing voice waveform data 404 obtained from a microphone when the melody of a certain musical piece is sung in advance, generates the second amplitude data group 111, and stores the generated second amplitude data group 111 in the memory 101 in FIG. 1.

The pitch detector 402 extracts a fundamental tone frequency (pitch) 406 of the vowel segment of each tone from the singing voice waveform data 404 based on the actual singing of the melody described above.

The subtractor 403 calculates a time series of the pitch variation data 112 by subtracting fundamental tone frequencies 405, which are for example model fundamental tone frequencies set in advance for the vowel segments of the tones included in the melody, from the fundamental tone frequencies 406 of the vowel segments of the tones included in the singing voice waveform data 404 based the above-described actual singing of the melody extracted by the pitch detector 402.

The consonant detector 407 determines segments of the singing voice waveform data 404 where tones exist but the pitch detector 402 did not detect fundamental tone frequencies 406 to be consonant segments, calculates the average amplitude of each of these segments, and outputs these values as the consonant amplitude data 113.

Figure 5:
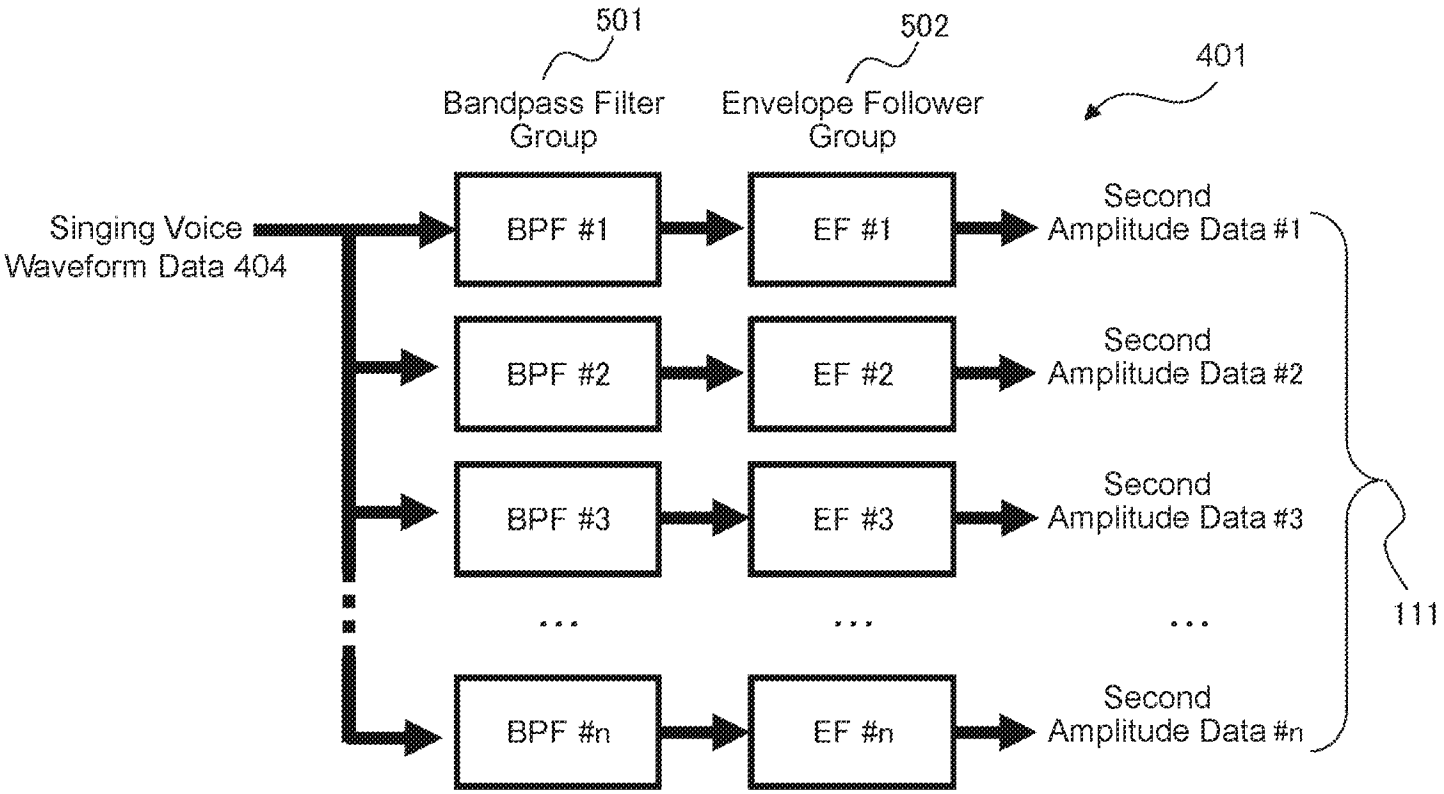
FIG. 5 is a block diagram illustrating the detailed configuration of a vocoder modulation device.

FIG. 5 is a block diagram illustrating in detail the vocoder modulation device 401 in FIG. 4. The vocoder modulation device 401 receives the singing voice waveform data 404 in FIG. 4 and includes a band pass filter group 501 composed of a plurality of band pass filters (BPF #1, BPF #2, BPF #3, . . . , BPF # n) that respectively allow a plurality of frequency bands to pass therethrough. The band pass filter group 501 has the same characteristics as the band pass filter group 201 in FIG. 2 of the vocoder demodulation device 104 in FIG. 1.

Furthermore, the vocoder modulation device 401 includes an envelope follower group 502 that is composed of a plurality of envelope followers (EF #1, EF #2, EF #3, . . . , EF # n). The envelope followers (EF #1, EF #2, EF #3, . . . , EF # n) respectively extract envelope data of changes over time in the outputs of the band pass filters (BPF #1, BPF #2, BPF #3, . . . , BPF # n), sample the respective envelope data every fixed period of time (for example, 10 msec), and output the resulting data as the pieces of second amplitude data 111 (#1 to # n). The envelope followers (EF #1, EF #2, EF #3, . . . , EF # n) are for example low pass filters that calculate the absolute values of the amplitudes of the outputs of the band pass filters (BPF #1, BPF #2, BPF #3, . . . , BPF # n), input these calculated values, and allow only sufficiently low frequency components to pass therethrough in order to extract envelope characteristics of changes over time.

Figure 6:
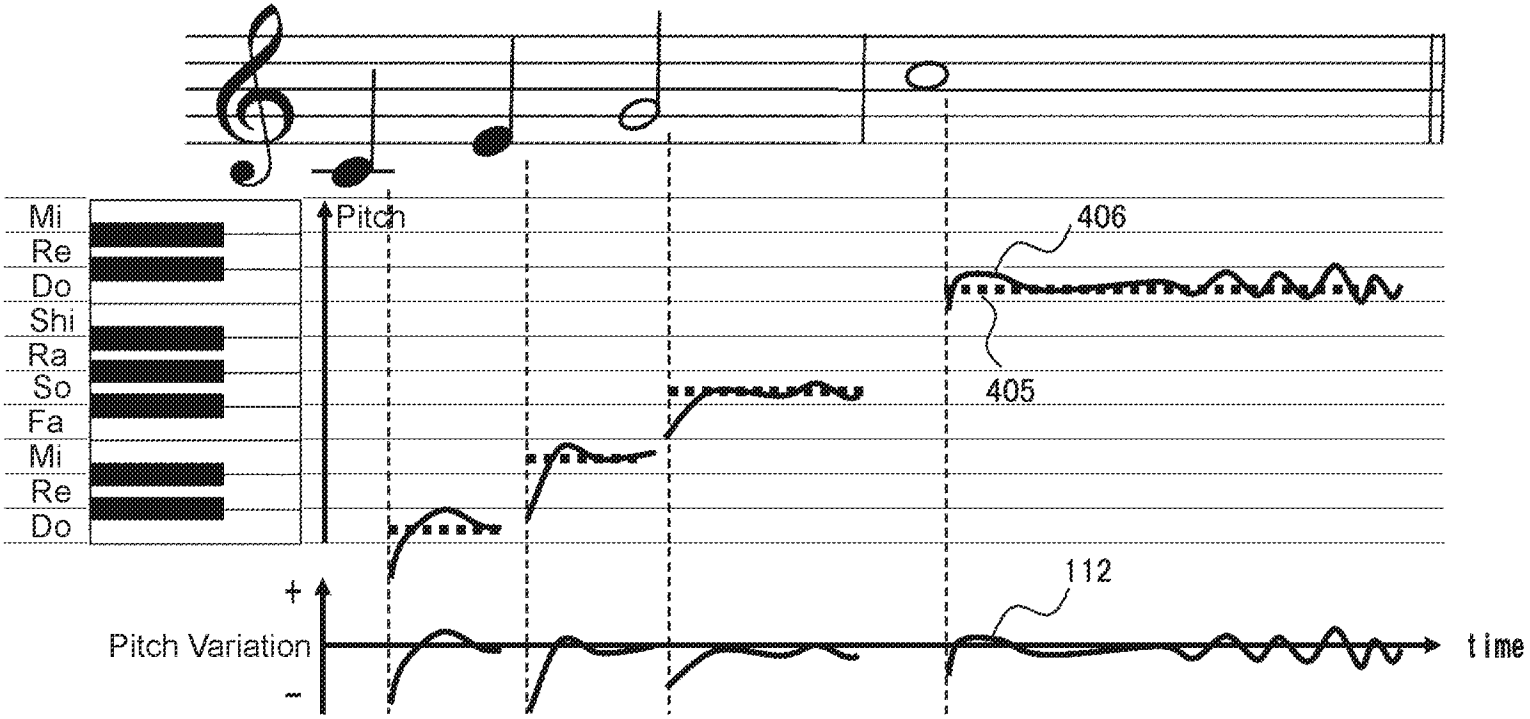
FIG. 6 is a diagram for explaining the manner in which pitch variation data is generated in the voice sound modulation device.

FIG. 6 is a diagram for explaining the manner in which the pitch variation data 112 is generated in the voice sound modulation device 400 in FIG. 4. For example, regarding the fundamental frequencies of the vowel segments of the tones of the singing voice waveform data 404 actually sung by a person, the frequencies vary with respect to the fundamental tone frequencies 405, which are for example model fundamental tone frequencies of the vowel segments of the tones of the melody represented by a musical score, and this leads to the feeling of individuality and naturalness of the singer. Consequently, in this embodiment, the pitch variation data 112 is generated by calculating the differences between the fundamental tone frequencies 405 of the vowel segments of the tones included in the melody obtained in advance and the fundamental tone frequencies 406 of the vowel segments of the tones detected by the pitch detector 402 from the singing voice waveform data 404 obtained when the melody is actually sung.

The singing voice waveform data 404 may be data obtained by storing the singing voice sung by a person in the memory 101 in advance before a performer performs the musical piece by specifying the operation elements, or may be data obtained by storing singing voice data output by a mechanism using a voice synthesis technology in the memory 101.

Figure 7:
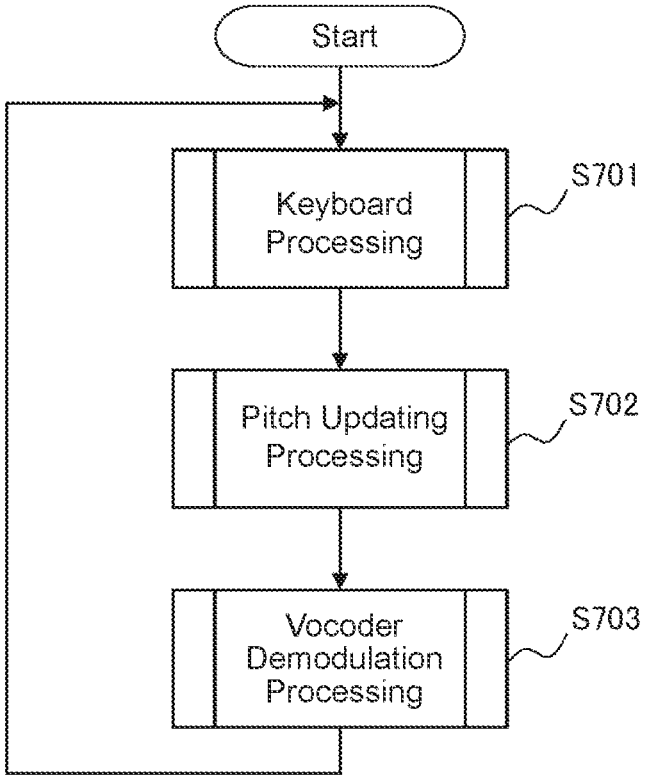
FIG. 7 is a flowchart illustrating an example of musical sound generating processing of the electronic musical instrument.

FIG. 7 is a flowchart illustrating an example of musical sound generating processing of the electronic musical instrument executed by the microcomputer 107 in FIG. 1. As described above, the musical sound generating processing is realized by the CPU inside the microcomputer 107 operating so as to execute a musical sound generating processing program stored in the ROM inside the microcomputer 107 and exemplified by the flowchart in FIG. 7 while using the RAM as a work memory.

When a user instructs starting of a lesson using the switch group 108 in FIG. 1, the processing of the flowchart in FIG. 7 begins, and keyboard processing (step S701), pitch updating processing (step S702), and vocoder demodulation processing (step S703) are repeatedly executed. The processing of the flowchart in FIG. 7 ends when the user instructs ending of the lesson using the switch group 108 in FIG. 1.

Figure 8:
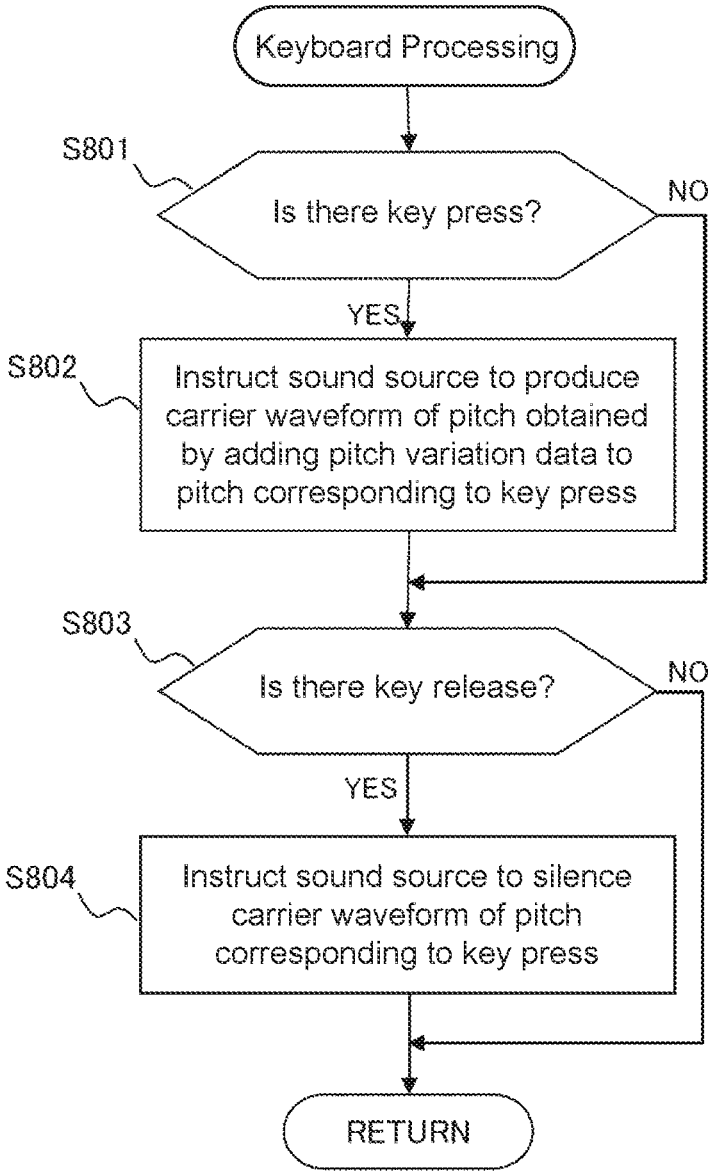
FIG. 8 is a flowchart illustrating a detailed example of keyboard processing.

FIG. 8 is a flowchart illustrating a detailed example of the keyboard processing of step S701 in FIG. 7. First, it is determined whether there is a key press among the keyboard operation elements 102 in FIG. 1 (step S801).

When the determination made in step S801 is YES, a sound generation start (note on) instruction is output to the sound source 103 in FIG. 1 (step S802) in order to output pitch-changed first waveform data 109 that has a pitch represented by changed pitch data 115 obtained by adding pitch variation data 112 to the performance specified pitch data 110 of the pitch corresponding to the key press. When the determination made in step S801 is NO, the processing of step S802 is skipped.

Next, it is determined whether there is a key release (step S803).

When the determination made in step S803 is YES, a sound production stop (note off) instruction is output to the sound source 103 in FIG. 1 such that the carrier waveform of the pitch corresponding to the key release is silenced.

After that, the keyboard processing of step S701 in FIG. 7 exemplified by the flowchart in FIG. 8 is finished.

Figure 9:
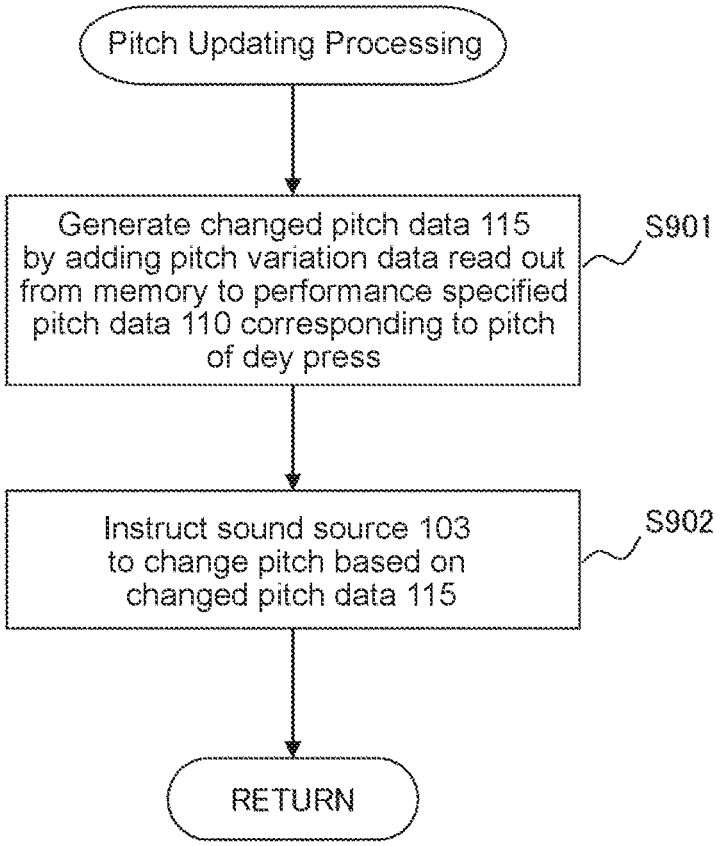
FIG. 9 is a flowchart illustrating a detailed example of pitch updating processing.

FIG. 9 is a flowchart illustrating a detailed example of the pitch updating processing of step S702 in FIG. 7. In this processing, the changed pitch data 115 is generated (step S901) by reading out the pitch variation data 112 (refer to FIG. 6) from the memory 101 as time passes from when the musical piece begins (time in FIG. 6), and adding the read out pitch variation data 112 to the performance specified pitch data 110 of the pitch corresponding to the key press.

Next, a pitch change instruction based on the changed pitch data 115 is issued to the sound source 103 (step S902). After that, the pitch updating processing of step S702 in FIG. 7 exemplified by the flowchart in FIG. 9 is finished.

Figure 10:
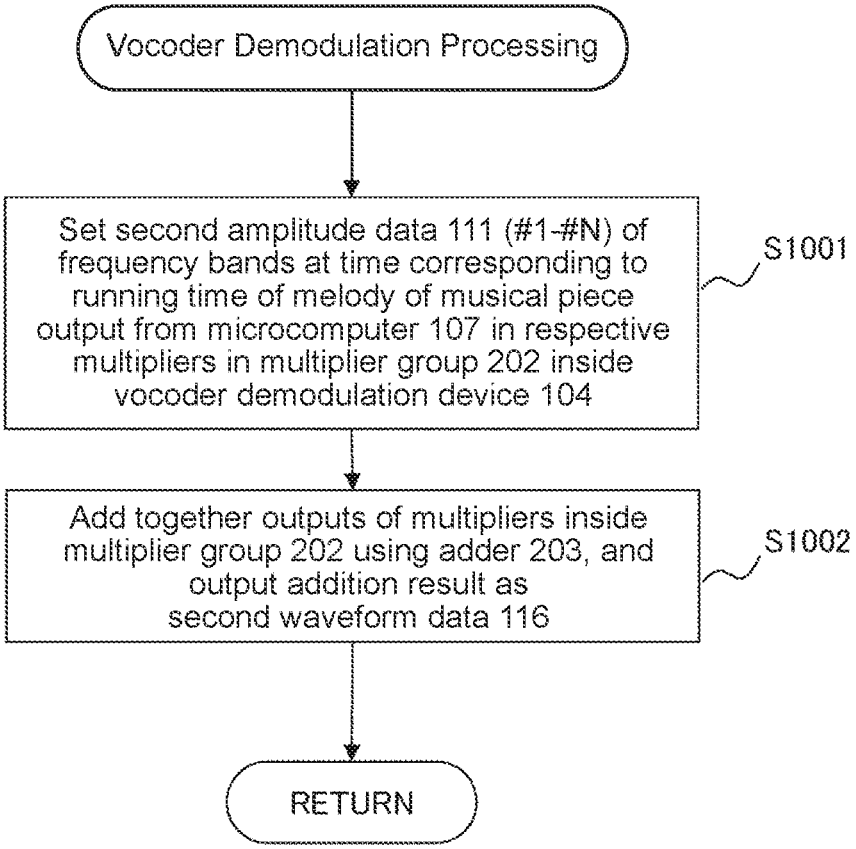
FIG. 10 is a flowchart illustrating a detailed example of vocoder demodulation processing.

FIG. 10 is a flowchart illustrating a detailed example of the vocoder demodulation processing of step S703 in FIG. 7. Pieces (#1 to # n) of the second amplitude data 111 (refer to FIG. 3) of the frequency bands at the time corresponding to the running time of the musical piece in FIG. 1 are read out and output to the multipliers (x #1 to x # n) inside the multiplier group 202 in FIG. 2 inside the vocoder demodulation device 104 in FIG. 1 (step S1001). The running time of the musical piece is for example timed by a timer built into the microcomputer 107 from a time point at which the user instructs starting of a lesson. Here, in a case where the time corresponding to the running time is not stored in the memory 101 exemplified in FIG. 5, amplitude data corresponding to the time value of the running time may be calculated using an interpolation calculation from amplitude data at the time stored in the memory 101 before or after the time value of the running time.

The outputs of the multipliers inside the multiplier group 202 in FIG. 2 are added together in the adder 203 inside the vocoder demodulation device 104, and the result of this addition is output as second waveform data 116 (step S1002). After that, the vocoder demodulation processing of step S703 in FIG. 7 exemplified by the flowchart in FIG. 10 is finished.

According to the above-described embodiment, the second waveform data 116 can be obtained in which the nuances of pitch variations in the singing voice waveform data 404 obtained from a singing voice singing a melody are reflected in the pitch-changed first waveform data 109 in FIG. 1 by the vocoder demodulation device 104. In this case, since not only changes in the waveform (formant) of an input voice but also changes in the pitch of the input voice can be reproduced, a sound source device can be realized that has an expressive power that is closer to that of a person's singing voice.

In addition, although a filter group (analysis filters, vocal tract analysis filters) is used to reproduce the formant of a voice with the aim of playing a singing voice using keyboard operation elements in this embodiment, if the present invention were applied to a configuration in which a natural musical instrument such as a wind instrument or string instrument is modeled using a digital filter group, a performance that is closer to the expression of the natural musical instrument could be realized by imitating the pitch variations of the wind instrument or string instrument in accordance with operation of the keyboard operation elements.

A method may also be considered in which a lyric voice recorded in advance is built in as pulse code modulation (PCM) data and this voice is then produced, but with this method, there is a large amount of voice sound data and producing sound with an incorrect pitch when a performer makes a mistake while playing is comparatively difficult. Additionally, there is a method in which lyric data is built in and a voice signal obtained through voice synthesis based on this data is output as sound, but this method has disadvantages that large amounts of calculation and data are necessary in order to perform voice synthesis and therefore real time control is difficult.

Since the need for an analysis filter group can be eliminated by performing synthesis using a vocoder method and analyzing amplitude changes at each frequency in advance in this embodiment, the circuit scale, calculation amount, and data amount can be reduced compared with the case in which the data is built in as PCM data. In addition, in the case where a lyric voice is stored in the form of PCM voice sound data and an incorrect keyboard operation element 102 is played, it is necessary to perform pitch conversion in order to make the voice match the pitch specified by an incorrect keyboard operation element when by the user, whereas when the vocoder method is adopted, the pitch conversion can be performed by simply changing the pitch for the carrier and therefore there is also the advantage that this method is simple.

Through cooperative control with the microcomputer 107, the vocoder demodulation device 104 in FIG. 1 functions as a filter unit that executes filtering processing on the pitch-changed first waveform data 109 by which a time series of voice spectral envelope data is sequentially read in and input from the memory 101 so as to apply a voice spectrum envelope characteristic to the pitch-changed first waveform data 109, and outputs the second waveform data 116 obtained by executing this filtering processing. Here, in addition to the vocoder demodulation device 104, the filter unit could also implemented using a digital filter such as a linear prediction synthesis filter obtained on the basis of linear prediction analysis or spectrum maximum likelihood estimation, a PARCOR synthesis filter obtained on the basis of partial correlation analysis, or an LSP synthesis filter obtained on the basis of line spectral pair analysis. At this time, the voice spectrum envelope data may be any group of parameters of linear prediction coefficient data, PARCOR coefficient data, or LSP coefficient data for the above-described digital filter.

In the above-described embodiment, the voice spectrum envelope data and the pitch variation data corresponding to a lyric voice of a musical piece are stored in advance in the memory 101.

Furthermore, the pitch variation data is added to the pitch for each key press in the above-described embodiment, but sound production may instead be carried out by using pitch variation data in note transition periods between key presses.

In addition, in the above-described embodiment, the microcomputer 107 generates the changed pitch data 115 by adding the pitch variation data 112 itself read out from the memory 101 to the performance specified pitch data 110 of a pitch corresponding to a key press in the pitch updating processing in FIG. 9 for example. At this time, rather than using the pitch variation data 112 itself, the microcomputer 107 may instead add the result of multiplying the pitch variation data 112 by a prescribed coefficient to the performance specified pitch data 110 on the basis of operation of the switch group 108 (FIG. 1) by the user for example. If the value of the coefficient at this time is "1" for example, a pitch variation based on actual singing is reflected as it is and the same intonation as in the actual singing is added to pitch-changed first waveform data 109 output from the sound source 103. On the other hand, if the value of the coefficient is greater than 1 for example, a larger pitch variation than in the actual singing can be reflected and an intonation with deeper feeling than in the actual singing can be added to the pitch-changed first waveform data 109.

A specific embodiment of the present invention has been described above, but the present invention is not limited to the above-described embodiment and various changes may be made without departing from the gist of the present invention. It will be obvious to a person skilled in the art that various modifications and variations can be made to the present invention without departing from the spirit or the scope of the present invention. Therefore, it is intended that the present invention encompass the scope of the appended claims and modification and variations that are equivalent to the scope of the appended claims. In particular, it is clearly intended that any part or whole of any two or more out of the above-described embodiment and modifications of the embodiment combined with each other can be considered as being within the scope of the present invention.

What is claimed is:

1. An electronic musical instrument comprising:

a memory that stores, before performance of a musical piece on the electronic musical instrument by a performer begins, pitch variation data that represents differences between fundamental tone frequencies of notes in a melody of the musical piece and fundamental tone frequencies of notes in prescribed singing voice waveform data, the prescribed singing voice waveform data representing or simulating a singing voice that is generated when a person actually sings the melody of the musical piece, and a plurality of pieces of amplitude data that represent characteristics of the singing voice generated on the basis of the prescribed singing voice waveform data and that respectively correspond to a plurality of frequency bands;

a sound source that outputs a pitch-adjusted carrier signal, the pitch-adjusted carrier signal being generated on the basis of the pitch variation data acquired from the memory and performance instruction pitch data that represent pitches specified by the performer during the performance of the musical piece on the electronic musical instrument, the pitch-adjusted carrier signal being generated even when the performer does not sing after performance of the musical piece begins; and a waveform synthesizing device that receives the pitch-adjusted carrier signal and that generates synthesized waveform data based on the pitch-adjusted carrier signal, the waveform synthesizing device including a plurality of band pass filters for the plurality of frequency bands, respectively, each receiving the pitch-adjusted carrier signal, the waveform synthesizing device modifying the pitch-adjusted carrier signal that has passed through the plurality of band pass filters in accordance with the plurality of pieces of amplitude data acquired from the memory for the plurality of frequency bands, respectively, and adding the so modified pitch-adjusted carrier signals for the plurality of frequency bands together so as to generate and output the synthesized waveform data.

2. The electronic musical instrument according to claim 1, wherein the memory further stores, before the performance of the musical piece by the performer begins, consonant amplitude waveform data generated on the basis of the prescribed singing voice waveform data, and wherein the pitch-adjusted carrier signal is superimposed by consonant segment waveform data generated in accordance with the consonant amplitude waveform data.

3. The electronic musical instrument according to claim 2, wherein the consonant amplitude waveform data stored in the memory is generated on the basis of amplitudes of segments of the prescribed singing voice waveform data where the fundamental tone frequencies of the tones were not detected.

4. The electronic musical instrument according to claim 1, further comprising:

a microcomputer that reads out the pitch variation data from the memory as time elapses from when the performance of the musical piece begins.

5. The electronic musical instrument according to claim 1, further comprising:

a microcomputer that reads out the pitch variation data from the memory as time elapses from when the performance of the musical piece begins, wherein the microcomputer reads out the plurality of pieces of amplitude data for each of the plurality of frequency bands from the memory in accordance with a time corresponding to a running time of the musical piece timed from a point in time at which the performer starts the performance.

6. The electronic musical instrument according to claim 1, wherein the prescribed singing voice waveform data stored in the memory is generated on the basis of a recorded actual singing voice of a person.

7. The electronic musical instrument according to claim 1, wherein the prescribed singing voice waveform data stored in the memory is singing voice data output by a mechanism using a voice synthesis technology.

8. The electronic musical instrument according to claim 1, further comprising a processor that generates adjusted pitch data on the basis of the pitch variation data acquired from the memory and the performance instruction pitch data that represent pitches specified by the performer during the performance of the musical piece and that outputs the adjusted pitch data to the sound source, wherein the sound source generates the pitch-adjusted carrier signal on the basis of the adjusted pitch data.

9. The electronic musical instrument according to claim 2, further comprising a consonant waveform generator that receives the consonant amplitude waveform data and generates the consonant segment waveform data.

10. A method performed by an electronic musical instrument that includes:

a memory that stores, before performance of a musical piece on the electronic musical instrument by a performer begins, pitch variation data that represents differences between fundamental tone frequencies of notes in a melody of the musical piece and fundamental tone frequencies of notes in prescribed singing voice waveform data, the prescribed singing voice waveform data representing or simulating a singing voice that is generated when a person actually sings the melody of the musical piece, and a plurality of pieces of amplitude data that represent characteristics of the singing voice generated on the basis of the prescribed singing voice waveform data and that respectively correspond to a plurality of frequency bands;

a sound source; and a waveform synthesizing device including a plurality of band pass filters for the plurality of frequency bands, respectively, the method comprising:

causing the sound source to output a pitch-adjusted carrier signal generated on the basis of the pitch variation data acquired from the memory and performance instruction pitch data that represent pitches specified by the performer during the performance of the musical piece on the electronic musical instrument, the pitch-adjusted carrier signal being generated even when the performer does not sing after performance of the musical piece begins; and causing the plurality of band pass filters of the waveform synthesizing device to receive the pitch-adjusted carrier signal, and causing the waveform synthesizing device to modify the pitch-adjusted carrier signal that has passed through the plurality of band pass filters in accordance with the plurality of pieces of amplitude data acquired from the memory for the plurality of frequency bands, respectively, and to add the so modified pitch-adjusted carrier signals for the plurality of frequency bands together so as to generate and output synthesized waveform data.

11. A non-transitory computer-readable storage medium having stored thereon a program executable by an electronic musical instrument that includes:

a memory that stores, before performance of a musical piece on the electronic musical instrument by a performer begins, pitch variation data that represents differences between fundamental tone frequencies of notes in a melody of the musical piece and fundamental tone frequencies of notes in prescribed singing voice waveform data, the prescribed singing voice waveform data representing or simulating a singing voice that is generated when a person actually sings the melody of the musical piece, and a plurality of pieces of amplitude data that represent characteristics of the singing voice generated on the basis of the prescribed singing voice waveform data and that respectively correspond to a plurality of frequency bands;

a sound source; and a waveform synthesizing device including a plurality of band pass filters for the plurality of frequency bands, respectively, the program causing the electronic musical instrument to perform the following:

causing the sound source to output a pitch-adjusted carrier signal generated on the basis of the pitch variation data acquired from the memory and performance instruction pitch data that represent pitches specified by the performer during the performance of the musical piece on the electronic musical instrument, the pitch-adjusted carrier signal being generated even when the performer does not sing after performance of the musical piece begins; and causing the plurality of band pass filters of the waveform synthesizing device to receive the pitch-adjusted carrier signal, and causing the waveform synthesizing device to modify the pitch-adjusted carrier signal that has passed through the plurality of band pass filters in accordance with the plurality of pieces of amplitude data acquired from the memory for the plurality of frequency bands, respectively, and to add the so modified pitch-adjusted carrier signals for the plurality of frequency bands together so as to generate and output synthesized waveform data.

* * * * *